US005550720A

United States Patent [19]

Carroll

[11] Patent Number: 5,550,720

[45] Date of Patent: Aug. 27, 1996

[54] ARTIFICIAL CHRISTMAS TREE WITH ELECTRIC SEPARABLE SEGMENTS

[76] Inventor: Grant A. Carroll, 801 Palo Duro St., Amarillo, Tex. 79106

[21] Appl. No.: 494,403

[22] Filed: Jun. 26, 1995

[51] Int. Cl.[6] ..... F21P 1/02

[52] U.S. Cl. ..... 362/123; 362/252; 362/410; 362/808; 428/20; 439/210; 439/211

[58] Field of Search ..... 428/18, 19, 20; 439/115, 208, 210, 211, 502, 505, 527; 362/122, 123, 249, 250, 252, 253, 427, 431, 808, 410, 413

[56] References Cited

U.S. PATENT DOCUMENTS

| | | | |
|---|---|---|---|
| 2,708,324 | 5/1955 | Wedden | 428/18 |
| 3,214,579 | 10/1965 | Pacini | 362/123 |
| 3,617,732 | 11/1971 | Fisher | 428/18 |
| 3,970,834 | 7/1976 | Smith | 428/20 |

*Primary Examiner*—Denise L. Gromada
*Assistant Examiner*—Alan B. Cariaso

[57] ABSTRACT

An artificial Christmas tree with electric separable segments comprising a trunk fabricated of a plurality of separable sections including a lowermost section, an uppermost section and intermediate sections therebetween, the section coupling with respect to each other by sliding the lower section of the next higher adjacent section into the upper extent of the next lower adjacent section, a plurality of branches, each with a pivot pin coupled to an adjacent portion of an associated trunk section to allow movement between a raised inoperative storage position parallel with the trunk sections a deployed operative position wherein the branches form an acute angle with its associated trunk section, each of the branches having artificial needles extending therefrom in a generally radial direction, a base adapted to be positioned on the recipient surface such as a floor, the base having an upper central section adapted to removably receive the lower extent of the lowermost trunk section, electrical components in each of the trunk sections and extending outwardly into each of the branches with associated electric lights for the illumination of the branches and tree when assembled, an electrical receptacle at the upper extent of the lowermost trunk section, at the lowermost extent of the uppermost trunk section and at the upper and lower extent of each intermediate trunk section and a plurality of electrical connectors, each electrical connector adapted to connect an electrical receptacle of adjacent trunk sections for providing electricity throughout the entire tree.

3 Claims, 4 Drawing Sheets

ARTIFICIAL CHRISTMAS TREE WITH ELECTRIC SEPARABLE SEGMENTS

BACKGROUND OF THE INVENTION

1. Field of the Invention

The present invention relates to an artificial Christmas tree with electric separable segments and more particularly pertains to illuminating an artificial christmas tree.

2. Description of the Prior Art

The use of artificial christmas trees of various designs and configurations is known in the prior art. More specifically, artificial christmas trees of various designs and configurations heretofore devised and utilized for the purpose of illuminating ornamental objects by various methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 3,571,586 an artificial Christmas tree with integral lighting means.

U.S. Pat. No. 3,704,366 discloses an outdoor lighted artificial Christmas tree.

U.S. Pat. No. 4,516,193 discloses a lighting system for artificial Christmas tree.

U.S. Pat. No. 4,777,571 discloses a Christmas tree lighting utilizing fiber optics.

Lastly, U.S. Pat. No. 5,104,608 discloses a programmable Christmas tree.

In this respect, the artificial Christmas tree with electric separable segments according to the present invention substantially departs from the conventional concepts and designs of the prior art, and in so doing provides an apparatus primarily developed for the purpose of illuminating an artificial christmas tree.

Therefore, it can be appreciated that there exists a continuing need for new and improved artificial Christmas tree with electric separable segments which can be used for illuminating an artificial christmas tree. In this regard, the present invention substantially fulfills this need.

SUMMARY OF THE INVENTION

In view of the foregoing disadvantages inherent in the known types of artificial christmas trees of various designs and configurations now present in the prior art, the present invention provides an improved artificial Christmas tree with electric separable segments. As such, the general purpose of the present invention, which will be described subsequently in greater detail, is to provide a new and improved artificial Christmas tree with electric separable segments apparatus and method which has all the advantages of the prior art and none of the disadvantages.

To attain this, the present invention essentially comprises a new and improved artificial Christmas tree with electric separable segments, comprising a trunk fabricated of a plurality of separable sections including a lowermost section, an uppermost section and intermediate sections therebetween, the section coupling with respect to each other by sliding the lower section of the next higher adjacent section into the upper extent of the next lower adjacent section, a plurality of branches, each with a pivot pin coupled to an adjacent portion of an associated trunk section to allow movement between a raised inoperative storage position parallel with the trunk sections a deployed operative position wherein the branches form an acute angle of about 60 degrees with its associated trunk section, each of the branches having artificial needles extending therefrom in a generally radial direction, a base adapted to be positioned on the recipient surface such as a floor, the base having an upper central section adapted to removably receive the lower extent of the lowermost trunk section, electrical components in each of the trunk sections and extending outwardly into each of the branches with associated electric lights for the illumination of the branches and tree when assembled, an electrical receptacle at the upper extent of the lowermost trunk section, at the lowermost extent of the uppermost trunk section and at the upper and lower extent of each intermediate trunk section, a plurality of electrical connectors, each electrical connector adapted to connect an electrical receptacle of adjacent trunk sections for providing electricity throughout the entire tree and a transformer located in the base for converting alternate current from a source of potential from a line to the electrical components within the trunk sections and branches.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved artificial Christmas tree with electric separable segments which has all the advantages of the prior art artificial christmas trees of various designs and configurations and none of the disadvantages.

It is another object of the present invention to provide a new and improved artificial Christmas tree with electric separable segments which may be easily and efficiently manufactured and marketed.

It is a further object of the present invention to provide a new and improved artificial Christmas tree with electric separable segments which is of a durable and reliable construction.

An even further object of the present invention is to provide a new and improved artificial Christmas tree with electric separable segments which is susceptible of a low cost of manufacture with regard to both materials and labor, and which accordingly is then susceptible of low prices of sale to the consuming public, thereby making such artificial christmas trees of various designs and configurations economically available to the buying public.

Still yet another object of the present invention is to provide a new and improved artificial Christmas tree with electric separable segments which provides in the apparatuses and methods of the prior art some of the advantages thereof, while simultaneously overcoming some of the disadvantages normally associated therewith.

Still another object of the present invention is to illuminating an artificial christmas tree.

Lastly, it is an object of the present invention to provide new and improved artificial Christmas tree with electric separable segments comprising a trunk fabricated of a plurality of separable sections including a lowermost section, an uppermost section and intermediate sections therebetween, the section coupling with respect to each other by sliding the lower section of the next higher adjacent section into the upper extent of the next lower adjacent section, a plurality of branches, each with a pivot pin coupled to an adjacent portion of an associated trunk section to allow movement between a raised inoperative storage position parallel with the trunk sections a deployed operative position wherein the branches form an acute angle with its associated trunk section, each of the branches having artificial needles extending therefrom in a generally radial direction, a base adapted to be positioned on the recipient surface such as a floor, the base having an upper central section adapted to removably receive the lower extent of the lowermost trunk section, electrical components in each of the trunk sections and extending outwardly into each of the branches with associated electric lights for the illumination of the branches and tree when assembled, an electrical receptacle at the upper extent of the lowermost trunk section, at the lowermost extent of the uppermost trunk section and at the upper and lower extent of each intermediate trunk section and a plurality of electrical connectors, each electrical connector adapted to connect an electrical receptacle of adjacent trunk sections for providing electricity throughout the entire tree.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
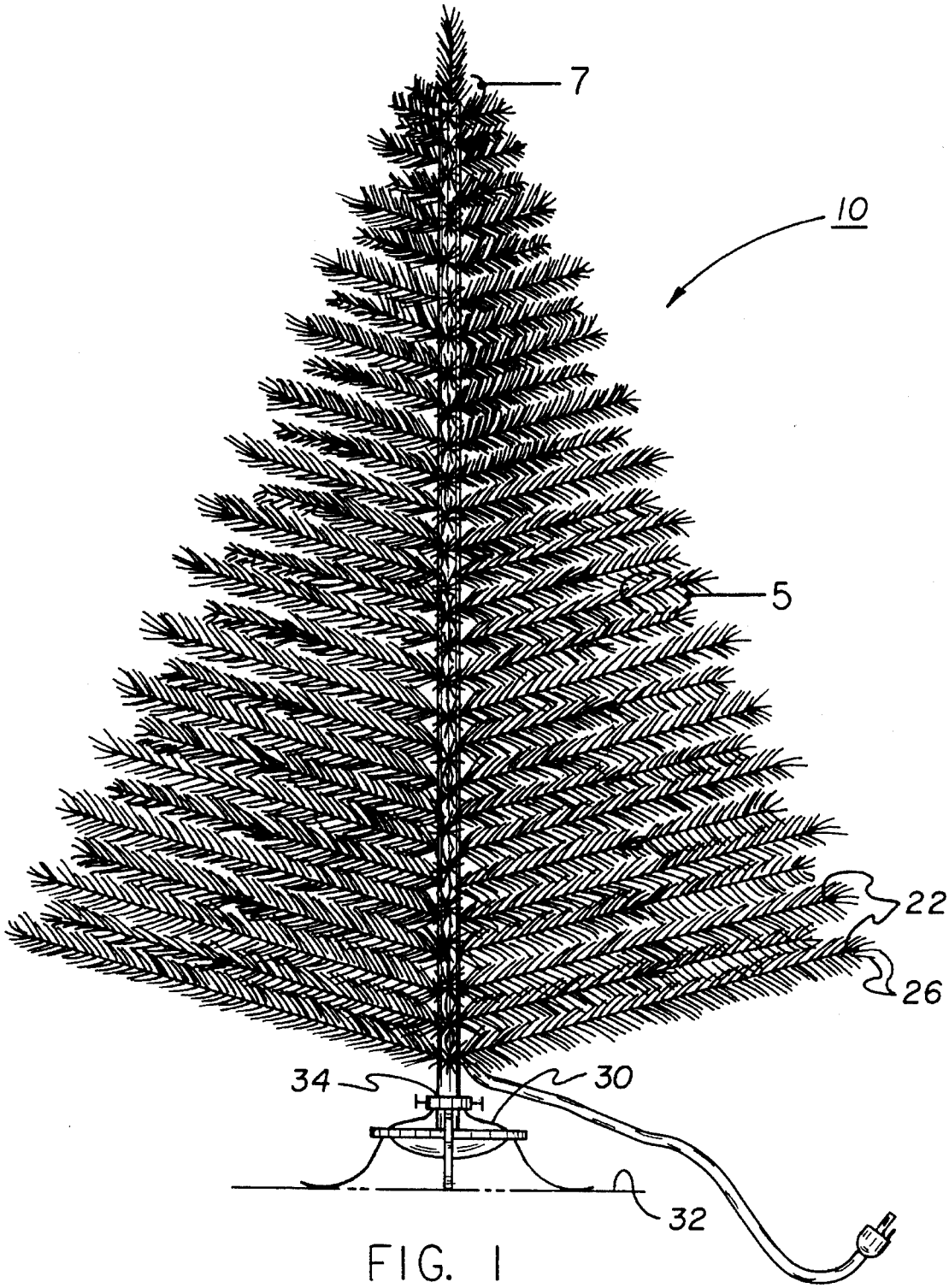
FIG. 1 is a front elevational view of the preferred embodiment of the new and improved artificial Christmas tree with electric separable segments constructed in accordance with the principles of the present invention.

With reference now to the drawings, and in particular to FIG. 1 thereof, a new and improved artificial Christmas tree with electric separable segments embodying the principles and concepts of the present invention and generally designated by the reference numeral 10 will be described.

The present invention, the new and improved artificial Christmas tree with electric separable segments, is comprised of a plurality of components. Such components in their broadest context include a trunk, branches, a base, electrical components, electrical receptacles, electrical connectors and a transformer. Such components are individually configured and correlated with respect to each other so as to attain the desired objective.

Figure 8:
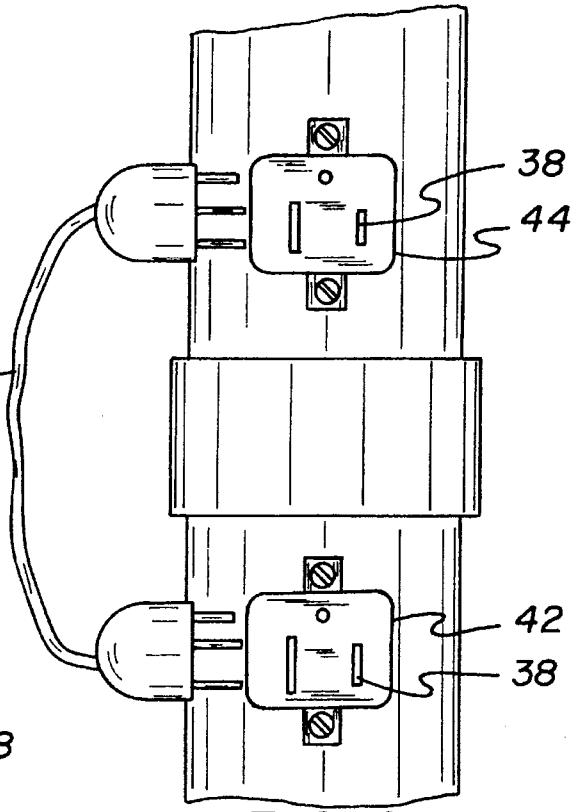
FIG. 8 is an enlarged front elevational view of that portion of the tree within circle 8 of FIG. 2.
Figure 7:
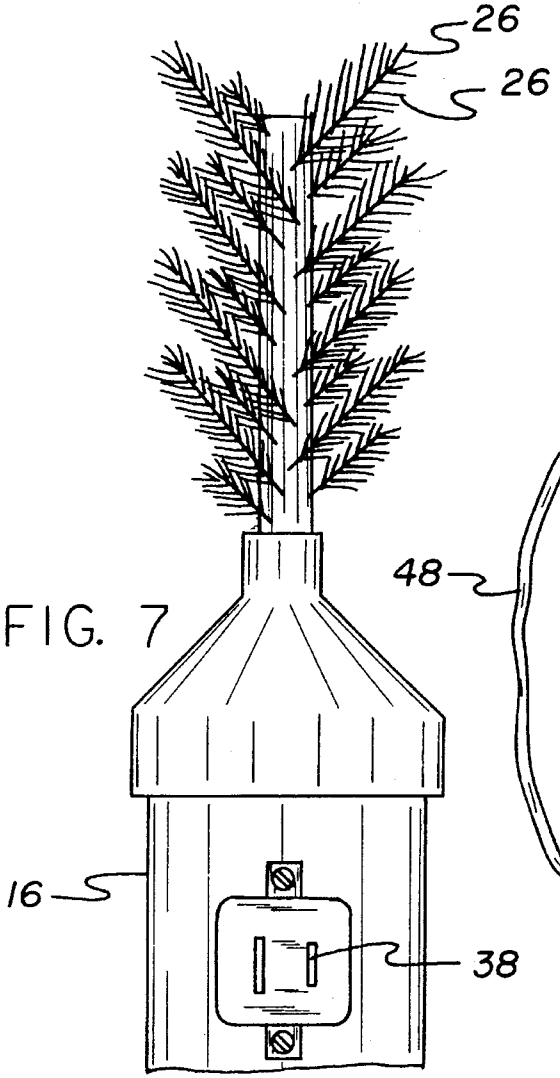
FIG. 7 is an enlarged front elevational view of the upper extent of the tree shown in FIG. 1 taken about circle 7 of FIG. 1.

More specifically, it will be noted that the Christmas tree of the present invention is a system 10 with separable electrical segments. The principal component is a trunk 12. The trunk is a generally cylindrical member which extends vertically. It is preferably fabricated of a plurality of separable sections. Such sections include a lowermost section 14, an uppermost section 16 and intermediate section 18 therebetween. The sections are adapted to couple with respect to each other by sliding the lower section of the next higher adjacent section into the upper extent of the next lower adjacent section. Note FIG. 8.

Figure 2:
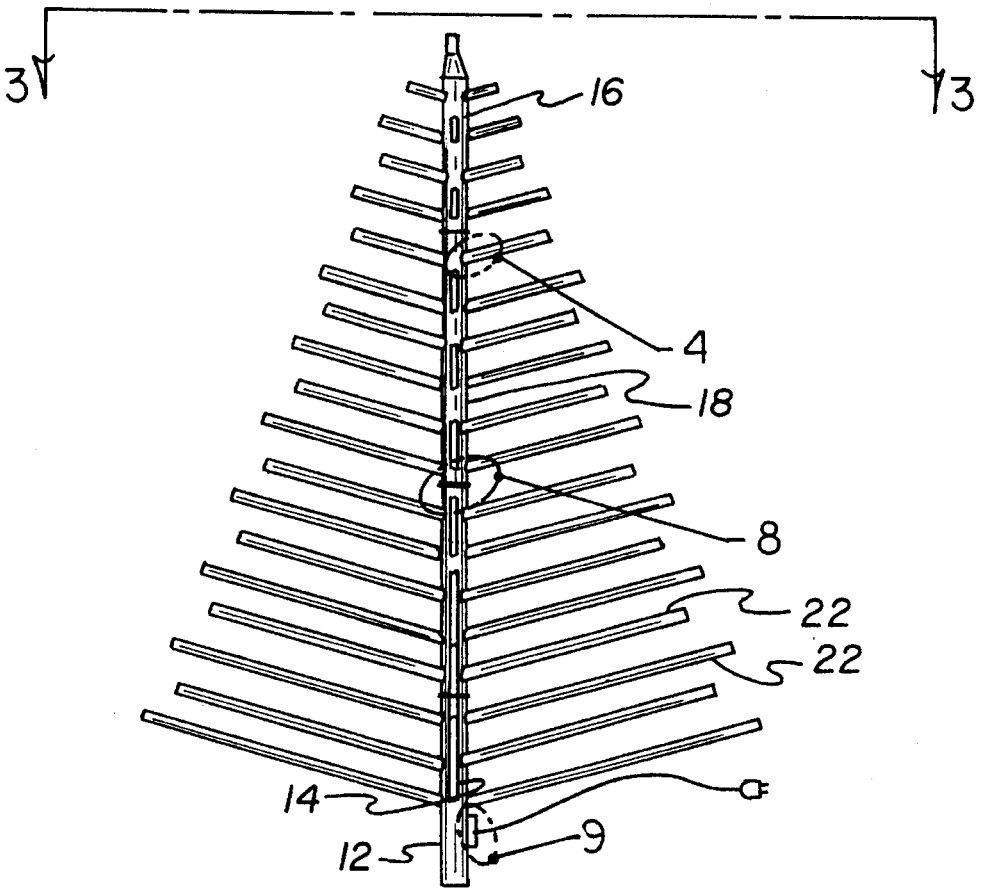
FIG. 2 is a schematic front elevational view of the Christmas tree shown in FIG. 1 but with the artificial needles removed.
Figure 3:
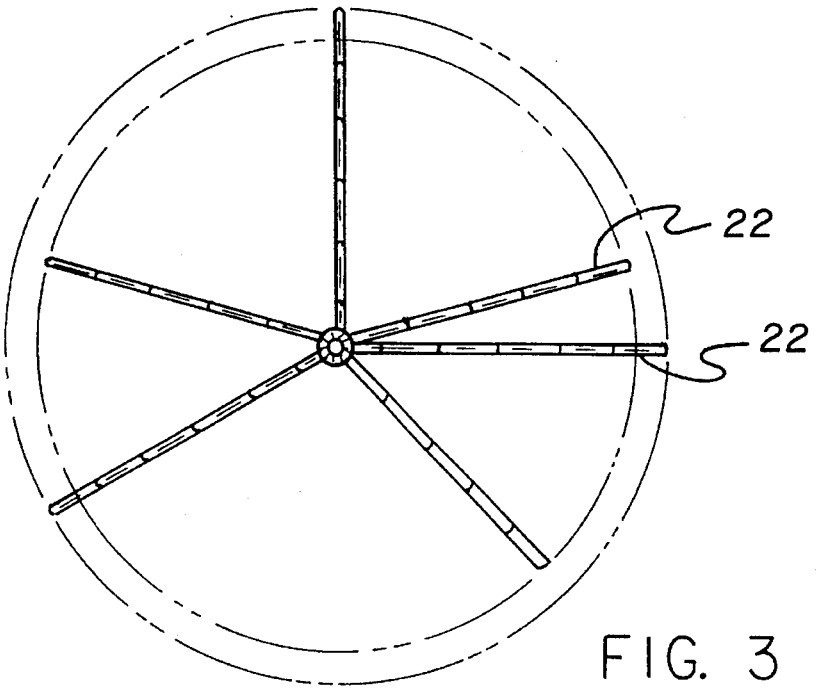
FIG. 3 is a top plan view of the tree shown in FIG. 2 taken along line 3—3 of FIG. 2.
Figure 4:
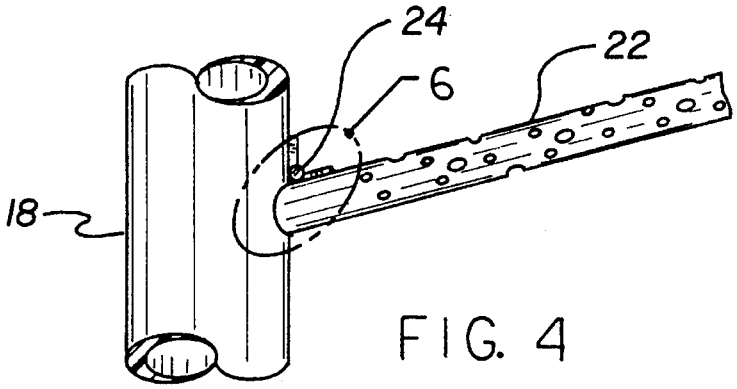
FIG. 4 is an enlarged front elevational view illustrating the coupling between the branches and the trunk of the tree shown in the prior Figure.
Figure 5:
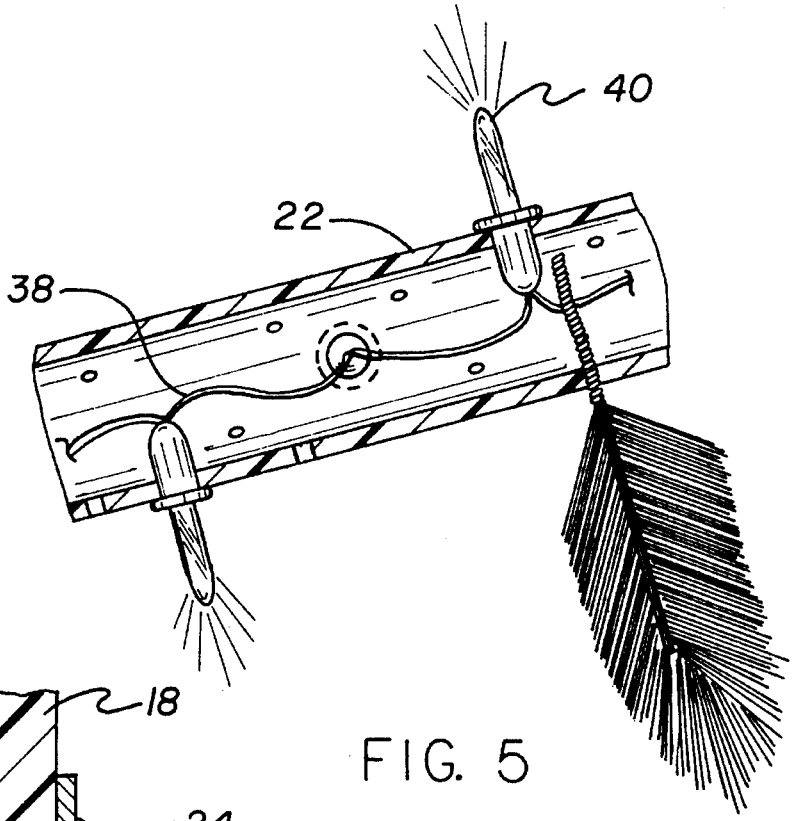
FIG. 5 is an enlarged cross-sectional view taken about circle 5 of FIG. 1.
Figure 6:
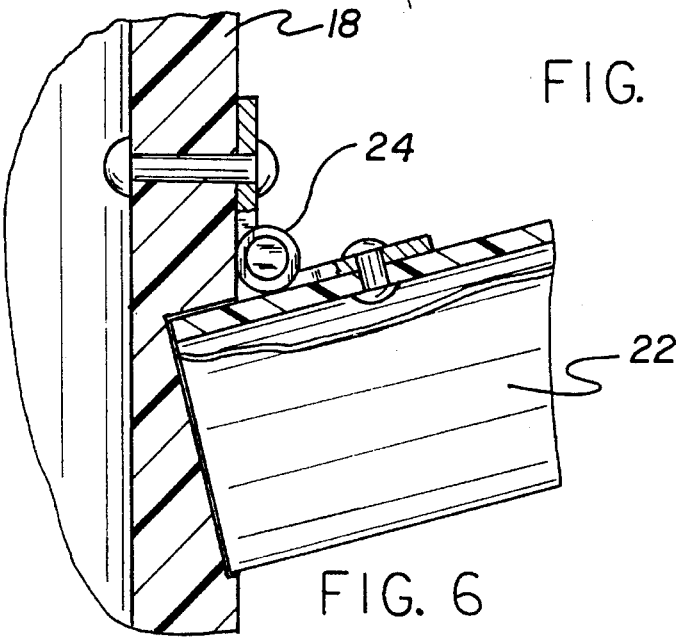
FIG. 6 is an enlarged cross-sectional view taken about circle 6 of FIG. 4.
Figure 9:
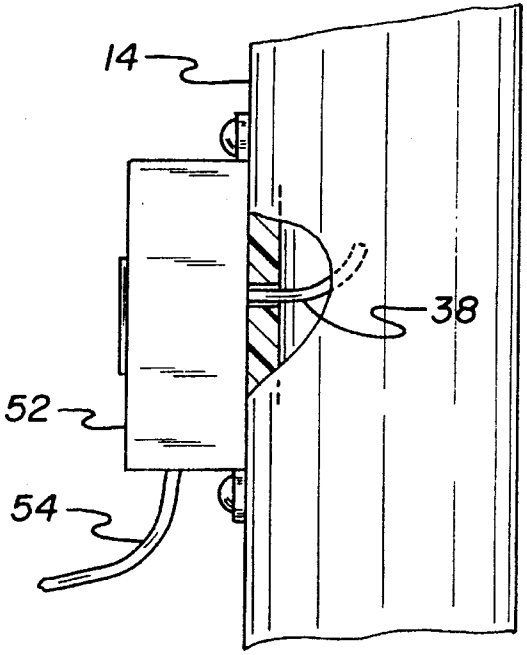
FIG. 9 is a front elevational view partially in section illustrating that portion of the tree trunk within circle 9 of FIG. 2.

The next component of the system 10 are a plurality of branches 22. Each of the branches is provided with a pivot pin 24 adjacent its interior edge in proximity to the trunk. The pivot pin 24 functions to couple an adjacent portion of an associated trunk section to the branches to allow movement of the branches between a raised inoperative storage position wherein the branches are parallel with the tree trunk sections and a deployed or operative position wherein the branches are as shown in FIGS. 1, 2, etc. When in such operative position, the branches form an acute angle of about sixty degrees with its associated trunk section. This is to simulate a natural pine tree. Each of the branches has artificial needles extending therefrom in a generally radial direction. This again is to simulate a natural pine tree which form the basis of most Christmas trees.

A base 30 constitutes the next major component of the system 10. The base is adapted to be positioned on a recipient surface 32 such as a floor. Note FIG. 1. The base has an upper central section 34 formed as an aperture to removably receive the lower extent of the lowermost trunk section when deployed for operation and use.

Electrical components 38 are provided in each of the trunk sections and extend outwardly into each of the branches. Such electrical components include wires for conducting current to electric lights 40. Such electric lights are located preferably on each branch and function for illuminating the branch and the tree when assembled.

Electrical current is provided among the sections of the trunk through electrical receptacles 42, 44. Such receptacles are located at the upper extent of the lowermost trunk, at the lowermost extent of the uppermost trunk and the upper and lower extent of each intermediate section. Coupling between the receptacles 42, 44 is through a plurality of electrical connectors 44. Such connectors include a short electrical wire with a plug at each end. Each electrical connector is adapted to connect an electrical receptacle of adjacent trunk sections. This is for providing electricity from the source at the lower extent of the lowermost trunk section throughout the entire tree.

Current is provided through the use of a transformer 52. Such transformer is located adjacent to the base at the lowermost extent of the lowermost trunk section. It is adapted for converting alternating current from a source of potential such as a conventional house outlet through a line 54. Such current is then provided to the electrical components within the trunk sections and branches to illuminate the lamps.

The artificial Christmas tree of the present invention is made from sturdy PVC pipe and comes with lights and branches already installed. It is easily stored between seasons.

The trunk of the tree is made from 1½" PVC pipe 4' long, painted brown to resemble a tree trunk. Wiring runs up the center o he pipe, and is connected to an outlet with a single plug. Branches are made from ⅜" PVC pipe painted green and attached to the trunk with a folding metal hinge that allows branches to be folded up along eh trunk for storage. Permanent 24 volt Christmas light sockets are mounted at about 3" intervals along each branch. Wire for the lights runs up the center of the branch/pipe. Artificial pine needles are attached to each branch. The top of the tree is a 2' long extension of ½" PVC pipe attached with a permanent cap and receptacle plug, decorated and wired like the branches.

Setting up the tree of this invention is simple. It is mounted in a standard Christmas tree stand, the branches folded down and the top extension attached. One plug lights all the permanently installed lights. Other decorations may be added as desired. The lights are connected in a parallel circuit so the other stay lit if one burns out. Storage follows the reverse procedure, with branches folded up and the top extension removed.

The Christmas tree of the present invention is easy to set up because lights and branches are permanently attached. It is brilliantly lit by standard lights, is completely safe, and is easily stored between seasons.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letter Patent of the United States is as follows:

1. An artificial Christmas tree with electric separable segments, comprising, in combination:

a trunk fabricated of a plurality of separable sections including a lowermost section, an uppermost section and intermediate sections therebetween;

a plurality of branches, each with a pivot pin coupled to an adjacent portion of one of the separable sections to allow movement between a raised inoperative storage position parallel with the trunk sections and a deployed operative position wherein the branches form an acute angle of about 60 degrees with its associated trunk section, each of the branches having artificial needles extending therefrom in a generally radial direction;

a base adapted to be positioned on a recipient surface such as a floor, the base having an upper central section adapted to removably receive a lower extent of the lowermost trunk section;

electrical components in each of the trunk sections and extending outwardly into each of the branches with associated electric lights for the illumination of the branches and tree when assembled;

an electrical receptacle at an upper extent of the lowermost trunk section, at a lowermost extent of the uppermost trunk section and at an upper and lower extent of each intermediate trunk section;

a plurality of electrical connectors, each electrical connector adapted to connect an electrical receptacle of adjacent trunk sections for providing electricity throughout the entire tree; and a transformer located in the base for converting alternate current from a source of potential from a line to the electrical components within the trunk sections and branches.

2. An artificial Christmas tree with electric separable segments comprising:

a trunk fabricated of a plurality of separable sections including a lowermost section, an uppermost section and intermediate sections therebetween;

a plurality of branches, each with a pivot pin coupled to an adjacent portion of one of the separable sections to allow movement between a raised inoperative storage position parallel with the trunk sections and a deployed operative position wherein the branches form an acute angle with one of the separable sections, each of the branches having artificial needles extending therefrom in a generally radial direction;

a base adapted to be positioned on a recipient surface such as a floor, the base having an upper central section adapted to removably receive a lower extent of the lowermost trunk section;

electrical components in each of the trunk sections and extending outwardly into each of the branches with associated electric lights for the illumination of the branches and tree when assembled;

an electrical receptacle at an upper extent of the lowermost trunk section, at a lowermost extent of the uppermost trunk section and at an upper and lower extent of each intermediate trunk section; and a plurality of electrical connectors, each electrical connector adapted to connect an electrical receptacle of adjacent trunk sections for providing electricity throughout the entire tree.

3. The Christmas tree as set forth in claim 2 and further including a transformer located in the base for converting alternate current from a source of potential to the electrical components within the trunk sections and branches.

* * * * *